United States Patent [19]

Bauer et al.

[11] 4,168,425

[45] Sep. 18, 1979

[54] ELECTRICAL HEATER CONSTRUCTION AND METHOD OF MAKING THE SAME

[75] Inventors: Frederick T. Bauer; Anthony C. Cairo, both of Holland, Mich.; Auzville Jackson, Jr., Richmond, Va.

[73] Assignee: Robertshaw Controls Company, Richmond, Va.

[21] Appl. No.: 789,814

[22] Filed: Apr. 22, 1977

[51] Int. Cl.[2] ..... H05B 3/02

[52] U.S. Cl. ..... 219/510; 337/220; 337/211; 219/494; 219/483

[58] Field of Search ..... 219/510, 483, 486, 485; 337/245, 115, 254, 336, 371, 309, 306, 315; 165/39; 337/211, 213, 220

[56] References Cited

U.S. PATENT DOCUMENTS

| | | | |
|---|---|---|---|
| 3,161,758 | 12/1964 | Biermann et al. | 219/486 |
| 3,435,189 | 3/1969 | Manecke | 219/486 X |
| 3,579,264 | 5/1971 | Mork et al. | 219/456 |
| 3,852,695 | 12/1974 | Northrup, Jr. | 337/96 |
| 3,873,791 | 3/1975 | Hurtle | 337/115 |
| 4,007,780 | 2/1977 | Caldwell et al. | 165/39 |
| 4,076,975 | 2/1978 | Tyler et al. | 219/486 |

*Primary Examiner*—Gerald P. Tolin
*Assistant Examiner*—M. Paschall
*Attorney, Agent, or Firm*—Candor, Candor & Tassone

[57] ABSTRACT

An electrical furnace heater construction having electrical heaters carried by a frame and having a current fused drawer-like lead unit movably carried by the frame and having leads for directly and electrically interconnecting to terminals of the heaters when the unit is in one position relative to the frame, the frame having terminals for electrically interconnecting the leads of the unit to power source leads so that the power source leads will be directly and electrically interconnected to the terminals of the heaters by the unit. A temperature responsive power device is carried by the frame and is responsive to the output temperature effect of the electrical heaters, the temperature responsive power device being operatively associated with the unit to move the unit out of the one position thereof to disconnect the leads thereof from the terminals of the heater when the temperature responsive device senses a certain adverse output temperature effect of said electrical heaters.

9 Claims, 7 Drawing Figures

ELECTRICAL HEATER CONSTRUCTION AND METHOD OF MAKING THE SAME

This invention relates to an improved electrical furnace heater construction and method of making the same.

It is well known that electrical heater constructions have been provided for electrical furnaces and the like wherein each electrical heater construction includes control means for interconnecting power source leads to the heater elements thereof.

For example, the copending patent application, Ser. No. 661,056, now U.S. Pat. No. 4,076,975, filed Feb. 25, 1976, discloses and claims an improved electrical heater construction that has a frame means carrying a plurality of electrical heaters and a control means therefor. A rigid lead module is carried by the frame means and has rigid lead means directly and electrically interconnected to the terminals of the heaters and the control means, the rigid lead module itself having terminal means for electrically interconnecting the rigid lead means thereof to power source leads whereby the power source leads will be directly and electrically interconnected to the terminal means of the heaters and the control means by the rigid lead means. In this manner, external wiring for the control system is held to an absolute minimum. The rigid lead module includes a plurality of drawer-like units or sections that contain fuse means in the rigid lead means thereof, the drawer-like units when pulled from an "in" position thereof, disconnecting the main power source leads from the terminal means of the electrical heaters and the control means to terminate the operation thereof.

It was found according to the teachings of this invention that it would be desirable to automatically move such fuse drawer-like units to electrical disconnecting positions thereof should the temperature of the heater means reach an unsafe condition thereof.

Accordingly, it is a feature of this invention to provide means for so operating the fuse drawer-like units of such an electrical heater construction or the like.

For example, one embodiment of this invention provides an electrical furnace heater construction having electrical heater means carried by frame means and having a current fused drawer-like lead unit movably carried by the frame means and having lead means directly and electrically interconnected to terminal means of the heater means when the unit is in one position relative to the frame means, the frame means having terminal means for electrically interconnecting the lead means of the unit to power source leads so that the power source leads will be directly and electrically interconnected to the terminal means of the heater means by the lead means when the unit is in the one position thereof. A temperature responsive power means is carried by the frame means and is responsive to the output temperature effect of the electrical heater means, the temperature responsive power means being operatively associated with the unit to move the unit out of the one position thereof to disconnect the lead means from the terminal means of the heater means when the temperature responsive means senses a certain adverse output temperature effect of the electrical heater means.

It is well known that piston and cylinder types of temperature responsive power means have been provided for operating valve members, heating duct dampers, greenhouse windows, etc. when such power means respectively sense certain temperatures. For example, see the U.S. patent to Caldwell et al, U.S. Pat. No. 4,007,780.

Accordingly, it is another feature of this invention to utilize such a piston and cylinder type of temperature responsive device to operate the fuse drawer-like units of the electrical heater construction of this invention as previously described and in the unique manner hereinafter illustrated and described.

Thus, it is an object of this invention to provide an improved electrical heater construction having one or more of the novel features of this invention as set forth above or hereinafter shown or described.

Another object of this invention is to provide an improved method of making such an electrical heater construction or the like, having one or more of the novel features of this invention as set forth above or hereinafter shown or described.

Other objects, uses and advantages of this invention are apparent from a reading of this description which proceeds with reference to the accompanying drawings forming a part thereof and wherein.

Figure 1:
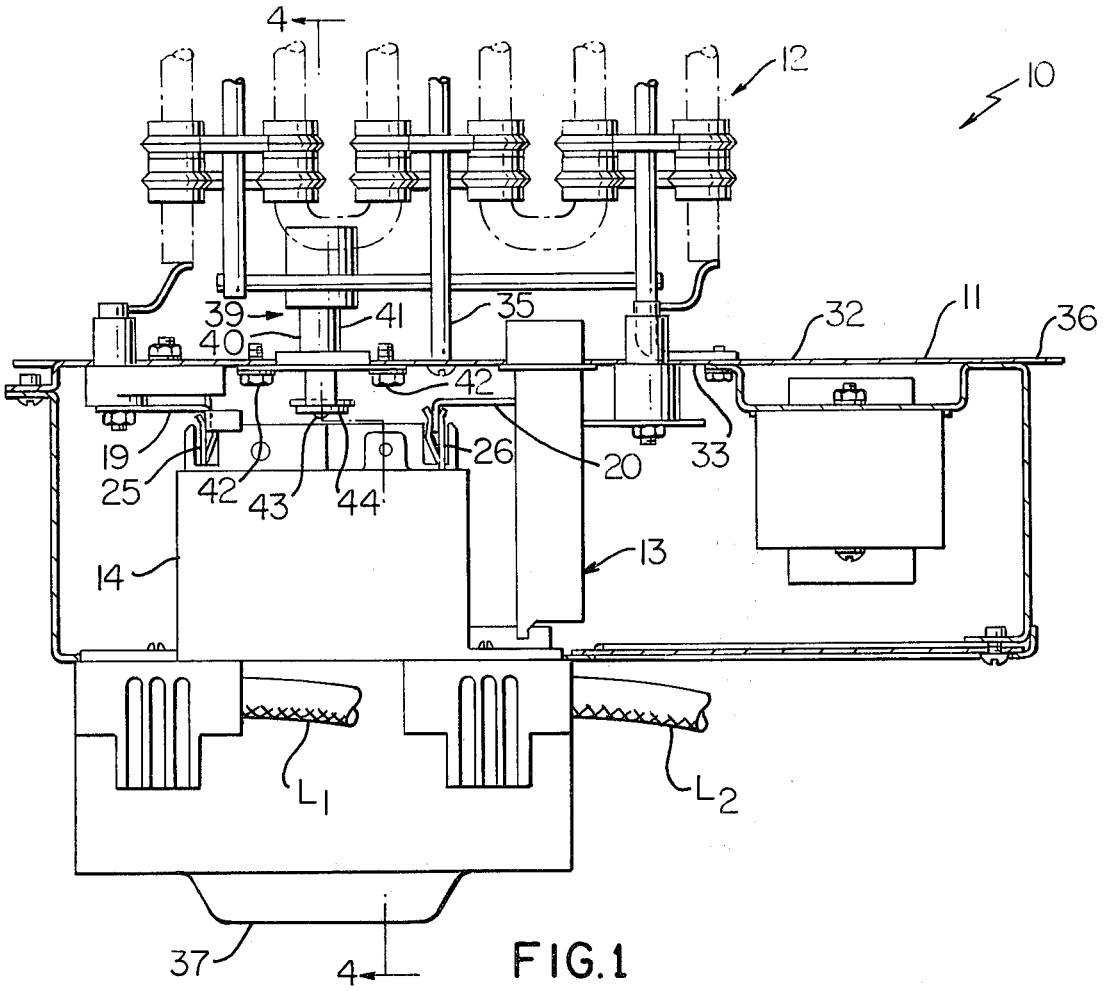
FIG. 1 is a fragmentary, partial cross-sectional top view of the improved electrical heater construction of this invention.

While the various features of this invention are hereinafter illustrated and described as being particularly adapted to provide an electrical heater construction for an electrical furnace, it is to be understood that the various features of this invention can be utilized singly or in any combination thereof to provide an electrical heater construction for other devices as desired.

Therefore, this invention is not to be limited to only the embodiment illustrated in the drawings, because the drawings are merely utilized to illustrate one of the wide variety of uses of this invention.

Figure 2:
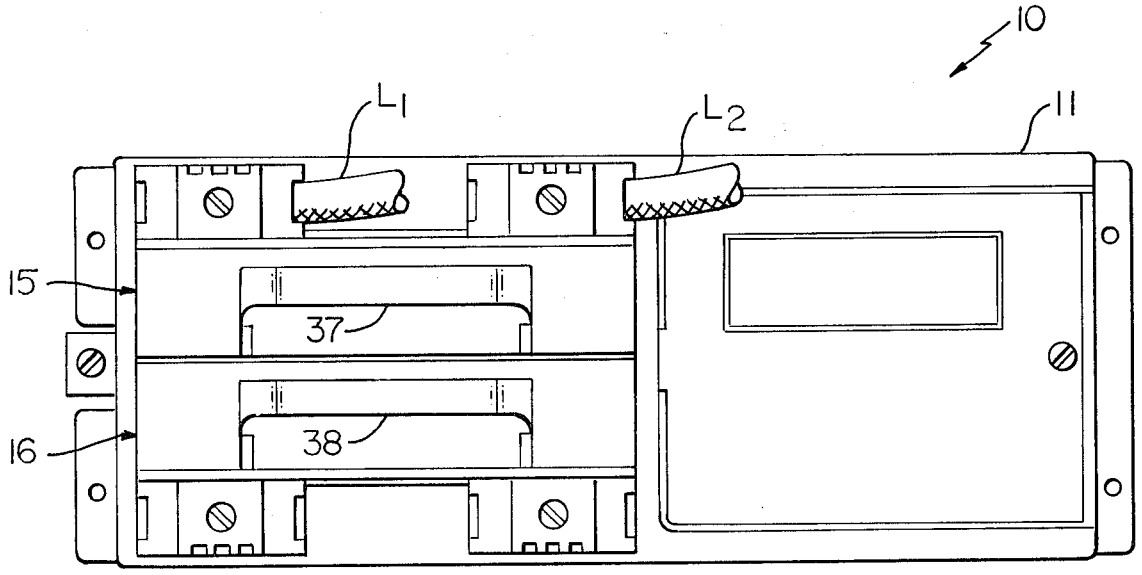
FIG. 2 is a front view of the heater construction of FIG. 1.

Referring now to FIGS. 1 and 2, the improved electrical construction of this invention for an electrical furnace or the like is generally indicated by the reference numeral 10 and comprises a frame means 11 adapted to be secured in an electrical furnace or the like in such a manner that a unit of one or more electrical heaters that is generally indicated by the reference numeral 12 is carried by the frame means 11 so as to be disposed within the heating chamber of the furnace to provide heat when the electrical heater unit or means 12 is effectively interconnected to power source leads L1 and L2 by an electrical sequencing switch construction that is generally indicated by the reference numeral 13 in FIG. 1 and is also carried by the frame means 11.

Since the general construction and operation of the electrical construction 10 of this invention is the same as that described and claimed in the aforementioned copending patent application, Ser. No. 661,056, the details of the structure and operation of the electrical construction 10 need not be fully set forth in this application as the copending patent application can be referred to for such information, if necessary.

Thus, it is believed that only the general features of the electrical construction 10 need now be described in order to understand the improved features of this invention.

Figure 4:
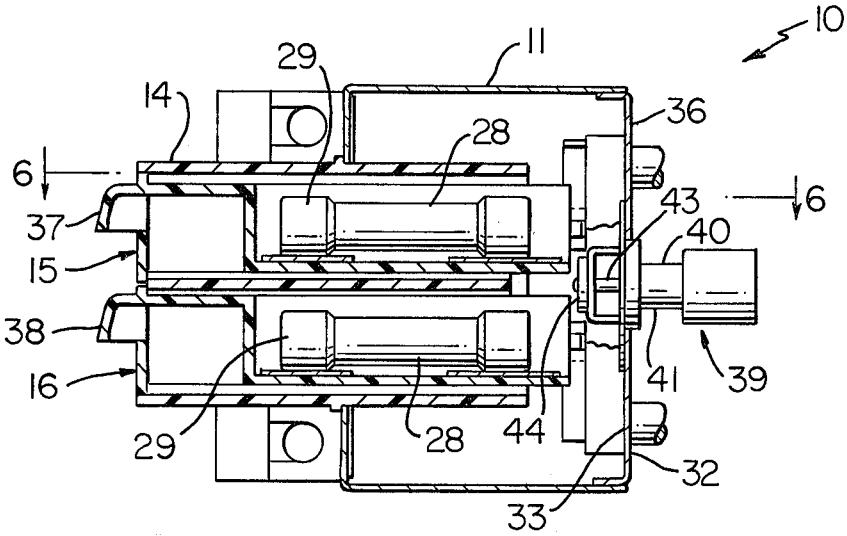
FIG. 4 is a fragmentary cross-sectional view taken on line 4—4 of FIG. 1.
Figure 5:
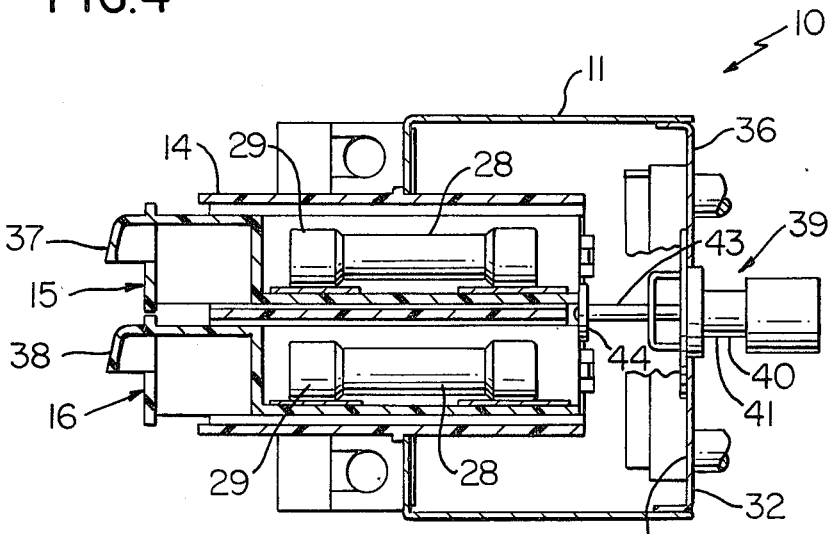
FIG. 5 is a view similar to FIG. 4 and illustrates the electrical heater construction during an unsafe heating condition thereof.
Figure 6:
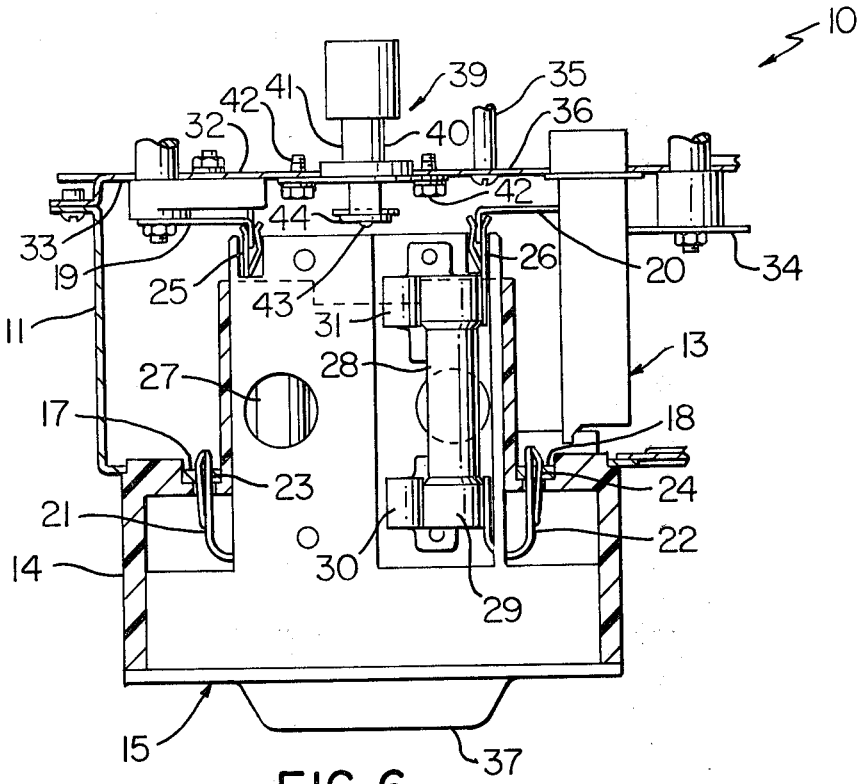
FIG. 6 is a fragmentary cross-sectional view taken on line 6—6 of FIG. 4.

In particular, the frame means 11 includes a housing means or module 14 that contains two movable drawer-like members or units that are generally indicated by the reference numerals 15 and 16 and each of which is adapted to be disposed in an "in" position in the housing means 14 in the manner illustrated in FIGS. 4 and 6 to electrically interconnect a pair of bus-bar terminals 17 and 18 carried by the housing means 14 to L-shaped terminal means 19 and 20 respectively of the heater means 12 and control means 13. However, when the drawer means 15 and 16 are either manually or automatically pulled or moved outwardly relative to the housing means 14 in the manner hereinafter described, the same disconnect the bus-bar terminal means 17 and 18 respectively from the L-shaped terminals 19 and 20 of the heater means 12 and control means 13 in the manner illustrated in FIGS. 5 and 7.

Figure 7:
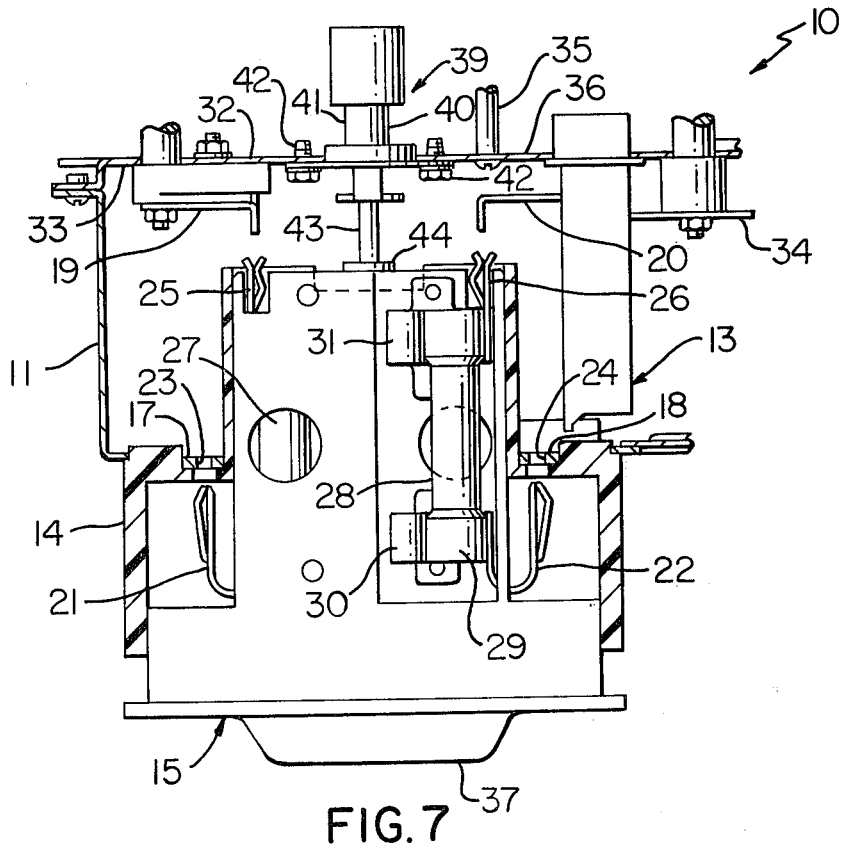
FIG. 7 is a view similar to FIG. 6 and illustrates the electrical heater construction during an unsafe heating condition thereof.

Each drawer-like unit 15 and 16 has a pair of looped rigid lead means 21 and 22 which are respectively adapted to be engageably received through opening means 23 and 24 in the bus-bar terminal means 17 and 18 when the respective drawer 15 or 16 is disposed in the "in" condition as illustrated in FIG. 6, such rigid lead means 21 and 22 being out of electrical contact with the terminal means 17 and 18 when the respective drawer 15 or 16 is in the "out" condition as illustrated in FIGS. 5 and 7.

Similarly, each drawer 15 and 16 is provided with a pair of rigid lead means 25 and 26 which are respectively adapted to be disposed in electrical connection with the respective terminal means 19 and 20 of the heater means 12 and control means 13 when the respective drawer means 15 or 16 is disposed in the "in" condition of FIG. 6 while being out of electrical contact therewith when the drawer means 15 or 16 is in the "out" condition as illustrated in FIGS. 5 and 7.

Each drawer-like unit 15 and 16 carries a pair of electrical fuses 27 and 28 which respectively electrically interconnect the rigid lead means 21 and 22 to the rigid lead means 25 and 26 thereof through the cooperating ends 29 of the fuses 27 and 28 and the conductive clips 30 and 31 that are carried by the respective drawer 15 or 16 and are electrically interconnected to the respective lead means 21, 22 and 25, 26 as illustrated.

Figure 3:
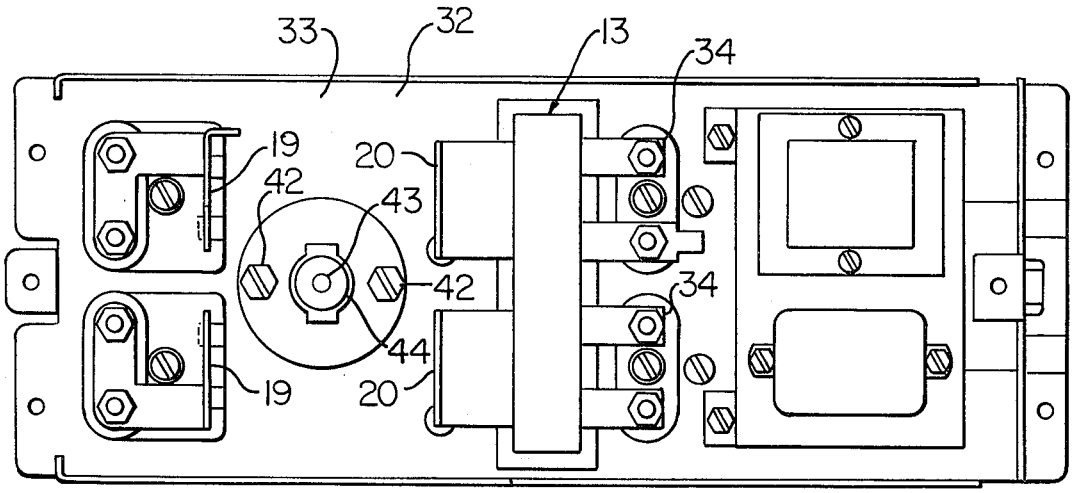
FIG. 3 is a view similar to FIG. 2 with the front cover and fuse module thereof removed.

As illustrated in FIG. 3, the frame means 11 includes a main frame plate 32 which carries the control means 13 on one side 33 thereof as well as the upper and lower terminals 19 of the electrical heater means 12 respectively for the drawer-like units 15 and 16, the control means 13 having upper and lower terminal means 20 for respectively being interconnected to the drawers 15 and 16. The terminals 19 of the plate 32 are interconnected to one side of the heater means 12, the other side of the heater means 12 being interconnected through connector means 34 to the control means 13 and, thus, from the control means 13 to the terminal means 20.

In this manner, external power source leads L1 and L2 that are interconnected to the housing means 14 of the framing means 11 are respectively electrically interconnected to the bus-bar terminal means 17 and 18 so that in order for electrical current to flow between the power source leads L1 and L2 through the heater means 12, not only must the control means 13 interconnect the terminal means 20 thereof to its side of the heater means 12, but also the drawer means 15 and 16 must be in the "in" condition of FIGS. 4 and 6 to respectively interconnect the bus-bar terminals 17 and 18 to the terminals 19 and 20 through the fuses 27 and 28 thereof. Thus, the power source leads L1 and L2 are respectively interconnected to the terminals 19 and 20 of the heater means 12 and the control means 13 for the reasons fully advanced in the aforementioned copending patent application for operating the electrical furnace or the like.

The heater means 12 is interconnected to the frame plate 32 by a suitable bracket means 35 so as to be disposed on the outer side 36 of the frame plate 32.

While the operator of the electrical construction 10 of this invention can readily pull out the drawer units 15 and 16 from the housing means 14 by grasping the handlelike portions 37 and 38 of the drawers 15 and 16 to remove such drawers from the housing means 14 to change blown fuses 27 and 28 or otherwise repair the construction 10 as the case may be, it can be seen that when the drawers 15 and 16 are moved outwardly to approximately the position illustrated in FIGS. 5 and 7 the electrical connection of the power source leads L1 and L2 to the heater means 12 and control means 13 is completely broken so that the heater means 12 cannot be operated unless the drawers 15 and 16 are in their fully "in" position in the housing means 14 in the manner illustrated in FIGS. 4 and 6 for the reasons previously set forth.

As previously stated, one of the features of this invention is to automatically move the drawer means 15 and 16 to the open position of FIGS. 5 and 7 should the temperature of the heater means 12 reach an unsafe limit thereof.

Accordingly, a temperature responsive power means that is generally indicated by the reference numeral 39 is carried by the frame means 11 to force the drawers 15 and 16 from their electrically interconnecting condition of FIGS. 4 and 6 to their electrically disconnecting condition of FIGS. 5 and 7 when the power means 39 senses an unsafe temperature.

In particular, the temperature responsive power means 39 comprises a piston and cylinder device 40 having a stepped cylinder portion 41 secured to the frame plate 32 by suitable fastening means 42 while the piston portion 43 of the device 40 extends through a suitable opening in the frame plate 32 to project beyond the side 33 thereof and carries a disc-like abutment 44 on the outer end to abut against both of the drawer-like units 15 and 16 in the manner illustrated in FIG. 5 and move the same outwardly relative to the housing means 14 when the piston 43 is extended out of the cylinder portion 41 by a suitable wax charge or the like therein being expanded by the temperature thereof having reached the unsafe level when the heater means 12 is in a run-away condition or the like.

Thus, it can be seen that it is a relatively simple operation to mount the temperature responsive device 40 to the frame means 11 of the electrical heater construction 10 of this invention so that the cylinder portion 41 thereof extends from the side 36 of the frame plate 32 to closely adjacent the heater means 12 and thereby readily sense the temperature thereof while the piston portion 43 thereof extends from the side 33 of the plate 32 to closely adjacent the fuse drawer units 15 and 16 to force the same out of their electrical interconnecting condition should the temperature being sensed by the device 40 exceed a certain safe level.

Once the device 40 has cooled sufficiently to permit the piston portion 43 thereof to retract into the cylinder portion 41 thereof, the drawer-like units 15 and 16 can be pushed back inwardly to their electrically interconnecting conditions of FIGS. 4 and 6 to again permit operation of the electrical heater construction 10 of this invention.

Therefore, it can be seen that during the normal operation of the electric heater construction 10 of this invention, the drawer-like units 15 and 16 while in their "in" condition of FIGS. 4 and 6 electrically interconnect the bus-bar terminal means 17 and 18 and, thus, the power source leads L1 and L2 to the terminal means 19 and 20 of the heater means 12 and control means 13 so that the control means 13 can operate the heater means 12 in an on-off cycling manner to tend to maintain the temperature output of the heater means 12 at the temperature setting of the control means 13 in the manner fully set forth in the aforementioned copending patent application.

However, if during such operation of the electrical heater construction 10 of this invention, should the output temperature effect of the heater means 12 exceed a safe level thereof, the wax charge or the like in the cylinder portion 41 of the temperature responsive device 40 expands in such a manner that the same extends the piston portion 43 outwardly relative to the piston portion 41 and thus causes the disc like portion 44 thereof to act against the drawer-like units 15 and 16 in the manner illustrated in FIGS. 5 and 7 to move the drawers 15 and 16 outwardly relative to the housing means 14 and thereby break the electrical connection not only between the lead means 21 and 22 and the power source terminal means 17 and 18, but also to break the electrical connection between the lead means 25 and 26 of the drawer-like units 15 and 16 and the terminal means 19 and 20 of the heater means 12 and the control means 13 whereby in order for the operator to again operate the heater means 12 of the construction 10, not only must the device 40 first return to a safe temperature thereof, but also the drawers 15 and 16 must be again manually moved back into the "in" condition. Thus, the operator, before returning the drawers 15 and 16 to the "in" condition will check out the electrical heater construction 10 to determine just what caused the heater malfunction and, thus, caused the device 40 to open the drawers 15 and 16 in the manner previously described so that such problem can be corrected.

Of course, the control means 13 and terminal means 19 for the heater means 12 can have temperature sensing safety means as set forth in the aforementioned copending patent application to terminate the electrical current flow through the heater means 12 should the power means 40 of this invention fail to perform in the above manner whereby the electrical heater construction 10 can have more than one type of over-temperature safety device, if desired.

Therefore, it can be seen that this invention not only provides an improved electrical heater construction, but also this invention provides an improved method of making such an electrical heater construction or the like.

While the form and method of this invention now preferred have been illustrated and described as required by the Patent Statute, it is to be understood that other forms and method steps can be utilized and still fall within the scope of the appended claims.

What is claimed is:

1. In an electrical furnace heater construction having electrical heater means carried by frame means and having current fused drawer-like lead unit movably carried by said frame means and having lead means directly and electrically interconnected to terminal means of said heater means when said unit is in one position relative to said frame means, said frame means having terminal means for electrically interconnecting said lead means of said unit to power source leads so that said power source leads will be directly and electrically interconnected to said terminal means of said heater means by said lead means when said unit is in said one position thereof, the improvement comprising a temperature responsive power means carried by said frame means and being responsive to the output temperature effect of said electrical heater means, said temperature responsive power means being operatively associated with said unit to move said unit out of said one position thereof to disconnect said lead means from said terminal means of said heater means when said temperature responsive power means senses a certain adverse output temperature effect of said electrical heater means.

2. An electrical heater construction as set forth in claim 1 and including control means carried by said frame means and having terminal means that are directly and electrically interconnected to said lead means of said unit when said unit is in said one position thereof.

3. An electrical heater construction as set forth in claim 1 wherein said temperature responsive power means comprises a piston and cylinder device, said device having a cylinder part thereof interconnected to said frame means and having a piston part thereof operatively associated with said unit to engage said unit and move said unit from one position thereof when said device senses said certain temperature.

4. An electrical heater construction as set forth in claim 3 wherein said frame means comprises a plate carrying said heater means on one side thereof and said unit on the other side thereof, said device being carried by said plate with said cylinder part thereof projecting from said one side thereof and said piston part projecting from said other side thereof.

5. An electrical heater construction as set forth in claim 1 and including another drawer-like unit movably carried by said frame means and being moved from said position thereof by said temperature responsive power means when said temperature responsive power means senses said certain temperature.

6. An electrical heater construction as set forth in claim 5 wherein said temperature responsive power means comprises a piston and cylinder device, said device having a cylinder part thereof interconnected to said frame means and having a piston part thereof operatively associated with said units to engage said units and move said units from said one position thereof when said device senses said certain temperature.

7. In an electrical furnace heater construction having a frame means carrying electrical heater means and a movable current fused drawer-like unit that is adapted to interconnect power source lead means to said heater means when said unit is in one position thereof relative to said frame means, the improvement comprising a temperature responsive power means carried by said frame means and being responsive to the output temperature effect of said electrical heater means, said temperature responsive power means being operatively associated with said unit to move said unit out of said one position thereof to disconnect said power source lead means from said heater means when said temperature responsive means senses a certain adverse output temperature effect of said electrical heater means.

8. In a method of making an electrical furnace heater construction having a frame means carrying electrical heater means and a movable current fused drawer-like unit that is adapted to interconnect power source lead means to said heater means when said unit is in one position thereof relative to said frame means, the improvement comprising the step of securing a temperature responsive power means to said frame means so as to be responsive to the output temperature effect of said electrical heater means and be operatively associated with said unit to move said unit out of said one position thereof to disconnect said power source lead means from said heater means when said temperature responsive means senses a certain adverse output temperature effect of said electrical heater means.

9. A method as set forth in claim 8 and including the step of forming said temperature responsive power means from a piston and cylinder device.

* * * * *